US005774946A

United States Patent [19]

Morgan

[11] Patent Number: 5,774,946

[45] Date of Patent: Jul. 7, 1998

[54] CLIP

[75] Inventor: Donald Albert Morgan, Chesham, United Kingdom

[73] Assignee: Marks & Clerk, United Kingdom

[21] Appl. No.: 741,835

[22] Filed: Oct. 31, 1996

[30] Foreign Application Priority Data

Nov. 1, 1995 [GB] United Kingdom ..... 9522360

[51] Int. Cl.[6] ..... A45D 8/24; A44B 21/00; B42F 1/00

[52] U.S. Cl. ..... 24/67.5; 24/67.7; 24/511; 24/499

[58] Field of Search ..... 24/489, 499, 507, 24/515, 303, 67.3, 67.5, 67.9, 67.11, 67 R, 243 R, 517, 511, 518, 543; 248/452, 442.2

[56] References Cited

U.S. PATENT DOCUMENTS

| | | | |
|---|---|---|---|
| 3,105,279 | 10/1963 | Westhoff | 24/67.5 |
| 3,246,914 | 4/1966 | Goodwin | 24/67.5 X |
| 3,597,813 | 8/1971 | Takahashi et al. | 24/67.5 |
| 3,756,550 | 9/1973 | Kollitz | 24/67.5 X |
| 3,968,546 | 7/1976 | Seaborn et al. | 24/67.9 |
| 4,014,077 | 3/1977 | Hitchcock et al. | 24/67.5 |
| 4,110,872 | 9/1978 | Gould | 24/67.11 |
| 4,628,572 | 12/1986 | Chang | 24/67.5 X |
| 4,662,039 | 5/1987 | Richardson | 24/511 X |
| 4,864,699 | 9/1989 | Whitcomb | 24/67.5 X |
| 4,902,078 | 2/1990 | Judd | 24/67.5 X |
| 4,953,266 | 9/1990 | Trinkaus | 24/499 |
| 5,104,088 | 4/1992 | Bakanowsky, III | 248/442.2 |
| 5,179,768 | 1/1993 | Jio | 24/499 X |
| 5,226,215 | 7/1993 | Evenson | 24/67.5 |
| 5,301,393 | 4/1994 | Brown | 24/67.7 |

FOREIGN PATENT DOCUMENTS

| | | | |
|---|---|---|---|
| 516564A1 | 12/1992 | France . | |
| 3019707 | 12/1981 | Germany | 24/67.5 |

*Primary Examiner*—Peter M. Cuomo
*Assistant Examiner*—Robert J. Sandy
*Attorney, Agent, or Firm*—Price, Heneveld, Cooper, DeWitt & Litton

[57] ABSTRACT

A hand operable clip 1 suitable for firmly releasably securing together sheets of, for example, paper. The clip 1 comprises a base 2 and a clip part 3 pivotally mounted with respect to one another. Biassing means are provided for biassing the gripping surfaces 7 and 8 of the clip part 3 and base 2 respectively in contact, comprising a resiliently deformable member 9 integrally moulded with the clip part 3 and a cam member having a cam surface 10 integrally moulded with base 2.

The gripping surface 7 of the clip part 3 is serrated to provide a good grip, and a pencil holder 11 is integrally formed with the clip part 3.

6 Claims, 2 Drawing Sheets

CLIP

The present invention relates to a clip of the sort which is hand operable and suitable for firmly releasably securing together sheets, e.g of paper.

Clips having two gripping surfaces biassed into contact, between which surfaces paper sheets can be firmly gripped, are well known. For example BULLDOG CLIPS (registered trade mark) and fold back clips are familiar in every office.

Clip boards are also well known, in which a clip is included in or integral with a board, for fixing loose paper onto a rigid surface.

Clips having sufficient clipping strength for most uses include a metal spring. For example, in the BULLDOG CLIP, (registered trade mark) a steel spring generally defining the curved faces of a cylinder provides both a pivot and biassing means for the gripping surfaces. Other parts of the clip maybe comprised of plastic.

It is desirable to minimise the number of parts required to manufacture a clip and to maximise the number of parts which are made of recyclable polymer material.

The present invention provides a clip made substantially wholly of polymeric material.

The design of the biassing means in a small clip can present particular problems, particularly when the biassing means is to be composed of thermoplastic material. The gripping edges must be biassed into contact with a certain initial tension to provide adequate grip. The gripping surfaces may need to be separable by a large distance, so that relatively large thicknesses may be gripped. Accordingly, the biassing means should have a suitable spring constant to prevent the gripping force becoming excessive at wide openings. Further, the biassing means should be compact and neat and should be kept out of the area of the clip where sheets are be gripped, to prevent the sheets being damaged. The biassing means should have a high strength, so that it is not broken or deformed at normal loads. The biassing means should also be tough, so that it is not weakened by repeated use.

These consideration pose considerable problems in designing for example an integral cast polymeric material biassing means for a clip.

Polymeric material when deformed under load will return almost to its original shape if the load does not exceed a given value. However, the material usually does not return exactly to the original shape. A polymeric material with a good "memory" is required i.e. a material which returns as closely as possible to its original shape.

The inventors of the present application have discovered that acetal can be moulded into a biassing means for a clip and gives good performance.

Accordingly, in a first aspect, the present invention provides a hand operable clip comprising first and second gripping members having respective gripping surfaces and biassing means for biassing the gripping surfaces into contact, the biassing means being formed of acetal resin. Acetal resin is also referred to as polyoxymethylene or aldehyde resin.

Any suitable molecular weight acetal resin may be used. The skilled person will be able to select a suitable grade of resin. Preferably it is a homopolymer. For example, DELRIN 500 (Reg. Trade Mark) from DuPont may be used.

The inventors of the present invention have realised that the normal arrangement of two gripping members pivotally movable with respect to one another and biassed into contact by a biassing means which acts on the gripping means in a generally circumferential direction does not provide adequate scope for designing the dimensions of the biassing means within the normal size constraints of a hand operable clip to overcome the above-mentioned problems. The present inventors have realised that a biassing means moving over a cam surface allows much greater control of the dimensions, deformation and properties of the biassing means and allows the above-mentioned problems to be balanced and overcome very effectively.

According to a second aspect, the present invention provides a hand operable clip comprising first and second members, each of which comprises a respective gripping surface, the first and second members being movably mounted with respect to one another, biassing means being provided for biassing the gripping surfaces of the first and second members into contact, wherein the biassing means comprises a resilient member acting on a cam surface to resist rotational movement of the members tending to separate the gripping surfaces.

According to a second aspect of the invention, the cam system can be arranged so that the resilient member is deformed at least partly in a direction generally normal to the direction of movement of the first and second members i.e in a generally radial direction where the members are pivotted with respect to one another. Preferably, the deflection of the resilient member in the direction normal to the movement of the first and second members is greater than the deflection in the second mentioned direction. Preferably, the deformation is completely in the direction normal to the second mentioned direction.

The provision of a resilient member acting against a cam surface in this way allows the rate of deformation with respect to movement of the first and second members with respect to one another to be freely set. It can be maintained at a very low level so that a relatively, tough, strong resilient member can be used which does not lead to an excessive increase in force at large openings of the clip. This is very suitable for a thermoplastic biassing means in which it is preferable to form the biassing means from a relatively tough, strong material which would have a relatively high spring constant.

The cam arrangement may be designed in any suitable manner. For example, the resilient means may move over a smoothly profiled cam surface. The camming effect may be achieved by the respective profiles and positions of both the resilient member and the cam surface. For example, either or both of the cam surface and the resilient member could define surfaces, each of which extends over varying radial distances from a centre of pivotal motion. The cam surface could comprise a simple sharp edge lying in the path of a resilient member which defines a surface which is located at a varying radial distance from the centre of pivotal motion.

Preferably, the first and second member are pivotally mounted with respect to one another.

Pivotal motion between the first and second members may be provided by any suitable means. It is not necessary for the motion to be exactly pivotal, as long as there is a substantial pivotal component to the motion.

The clip may comprise at least two members not integral with one another and movable or journalled with respect to one another. Alternatively, the first and second members may be different parts of a single integral or permanently rigidly assembled formation.

The present invention in both aspects is particularly suitable for a clip which can be operated by one hand only. This limits the maximum size and maximum force to which it is preferable to design the clip. For example, it is preferable that parts of the clip for engagement by the fingers are no more than at the most 20 cm apart, preferably no more than 12 cm, most preferably about 3–6 cm apart.

The force exertable between the gripping surfaces and the separation between gripping surfaces achievable should be substantially the same as for normal known FOLD BACK or BULLDOG (Registered trade mark) clips of comparable size. For example, a clip having gripping surfaces contacting over a length of about 5 cm should be able to lift a stack of at least ten, preferably at least twenty DIN A4 100 g/m$^2$ 100% recyled CROXLEY HERITAGE paper (Registered trade mark) sheets.

The clip according to the second aspect of the invention may be constructed in any suitable material, for example metal.

In both aspects of the present invention, it is preferred that the clip should be composed entirely of polymeric or thermoplastic material. Preferably, it comprises just two parts, preferably moulded, pivotally mounted with respect to one another. In that case, the resilient member will be integrally formed on one of the parts. This part, according to the first aspect of the invention, is composed of acetal.

The other part need not be comprised of acetal. Any suitable polymeric material may be selected according to the skill of the person skilled in the art. For example, it may comprise polypropylene.

The first and second members can preferably be snap fitted together.

Certain features may be included in the clip to make it suitable for stationery purposes. For example, means for holding a pen or pencil may be integrally formed on a part of the clip. Surfaces operable by a users fingers may have a suitable profiling to allow a good grip. Gripping surfaces may be serrated or roughened to provide a good grip on paper.

When formed of polymeric material, strengthening webs and bars may be provided according to the skill of the person skilled in the art to provide adequate strength and rigidity to the clip.

In a suitable embodiment of the invention for one handed use, the resilient member is between 1 cm and 4 cm, preferably 2 cm long. It may be between 1 cm and 4 cm, preferably 2 cm wide. It may taper to a sharp edge. it may be of thickness in the region 1.5–2.0 mm, preferably 0.5–4. Omm at its thickest part. The first and second member may be in the region 1.0–5.0 mm, preferably 2.2 mm thick. According to a preferred embodiment, there is provided a clip board comprising a thermoplastic board having integral means at one end for engaging a gripping member, the integral means and the gripping member together forming a clip according to the first or second aspect of the invention.

The resilient member of the clip according to the first aspect of the present invention is preferably formed of acetal homopolymer. Preferably, it is Du Pont Delrin 500.

The present invention will be further described by way of example only with reference to the accompanying drawings in which.

Figure 1:
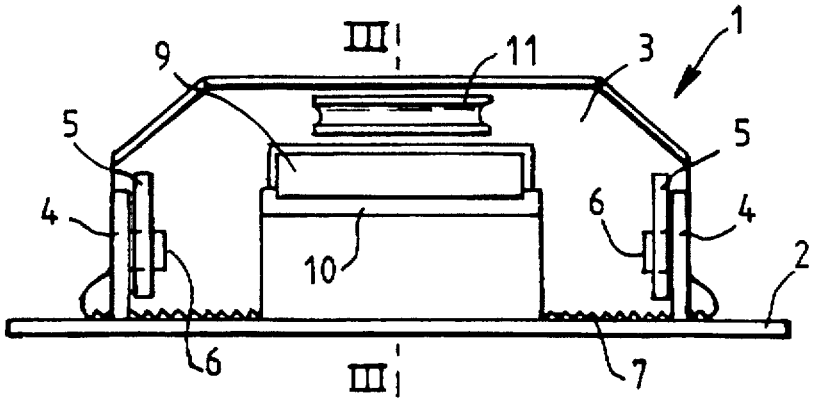
FIG. 1 is a rear view of a clip according to the second aspect of the invention.

In the clip 1 shown in FIG. 1 there is a first member in the form of a base 2 of polypropylene and a second member in the form of a clip part 3. According to the first invention, the clip part 3 is of acetal (in this case, DELRIN 500 [registered trade mark]). The base 2 and clip part 3 are pivotally mounted with respect to one another. Projections 4 and 5 are provided projecting from the base and the clip part 3 respectively, a pivot 6 being provided on projection 4 and engaging in a pivot hole in projection 5.

In order to bias gripping surfaces 7 and 8 of the clip part 3 and base 2 respectively into contact, a biassing means is provided comprising a resiliently deformable member 9 integrally moulded with the clip part 3 and a cam member having a cam surface 10 integrally moulded with base 2.

The gripping surface 7 of the clip part 3 is serrated to provide a good grip. A pencil holder 11 is integrally formed with the clip part 3.

Figure 2:
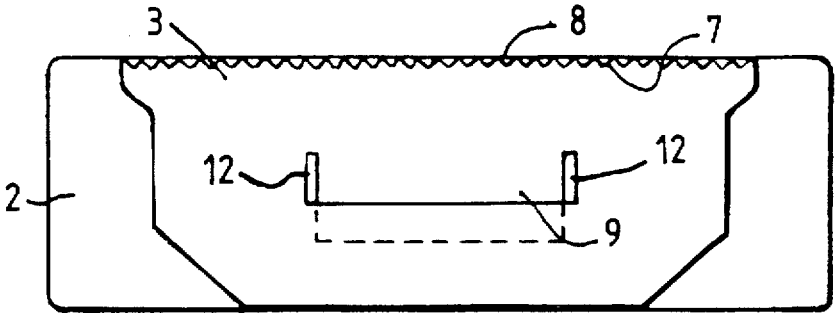
FIG. 2 is a plan view of a clip according to the second aspect of the invention.

As can be seen in FIG. 2 the resilient member 9 is fixed to the clip part 3 at its base. In order to provide an adequate length of resilient member so that the strains imposed by deformation of the resilient member 9 will not be too high, the resilient member 9 is separated from the clip part 3 by slits 12 along part of its length. The resilient member 9 has a projecting tongue 13 as shown in FIG. 3.

Figure 3:
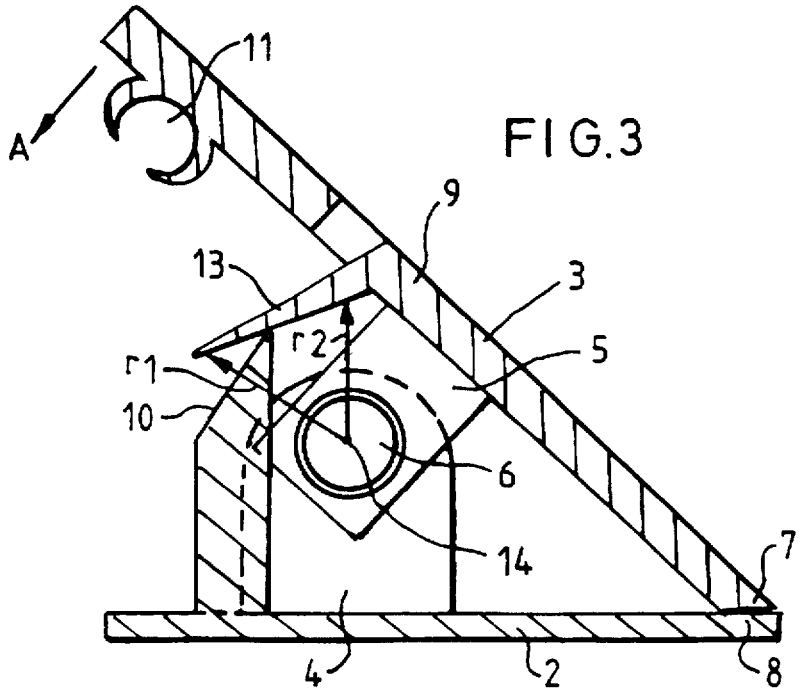
FIG. 3 is a vertical section on line III of FIG. 1.

FIG. 3 shows the centre 14 about which the clip part 3 pivots with respect to the base 2. The radial distances (for example $r_1$, $r_2$) from this centre 14 of parts of the surface of the tongue 13 are different over its length. That is, $r_1 > r_2$. When the gripping surfaces 7 and 8 are in contact, the tongue 13 comes to rest against the cam surface 10. The cam surface 10 comprises a bevelled edged part lying in the path of motion that the tongue 13 takes when the clip part 3 is moved with respect to the base 2. When the members are pivoted with respect to each other, the tongue 13 slides over the cam surface 10 and, as the tongue is of varying radial distance from the centre 14, the tongue 13 must deflect outwards to allow the motion to occur. This provides a biassing force resisting rotation of the clip part 3 in the direction of arrow A.

The variation in radial distance of parts of the tongue surface 13 over its length is chosen such that the increase in resistive force during rotation of the clip part 3 in the direction of arrow A is controlled and so that the strain imposed on the resilient part 9 is not such as to permanently deform it.

Figure 4:
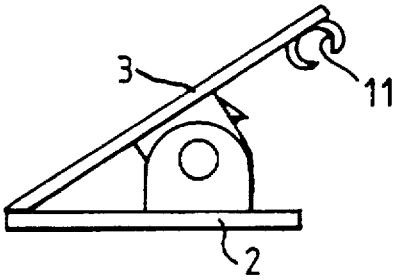
FIG. 4 is a vertical side elevation of the clip of FIG. 1.
Figure 5:
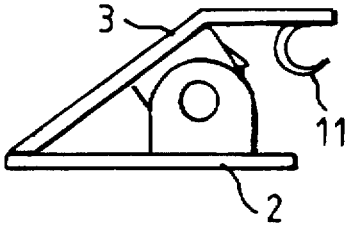
FIGS. 5 and 6 show alternative embodiments of clip according to the second aspect of the invention in vertical side elevation.
Figure 6:
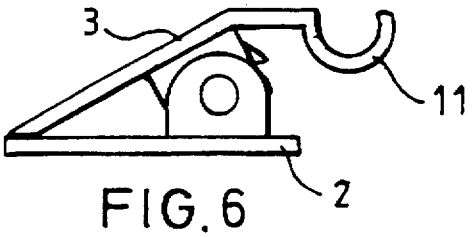

FIGS. 4, 5 and 6 are included to show various forms of the clip part 3 on a single common form of base 2. The resilient means 9 and projecting means 5 of FIG. 1 are retained in the clip part of all of FIGS. 4–6. However, the free end of clip part 3 is arranged in FIGS. 5 and 6 so that it does not project as far above the base 2 as it does in FIG. 4. In each case, means 11 for holding a pen or pencil is included.

Figure 7:
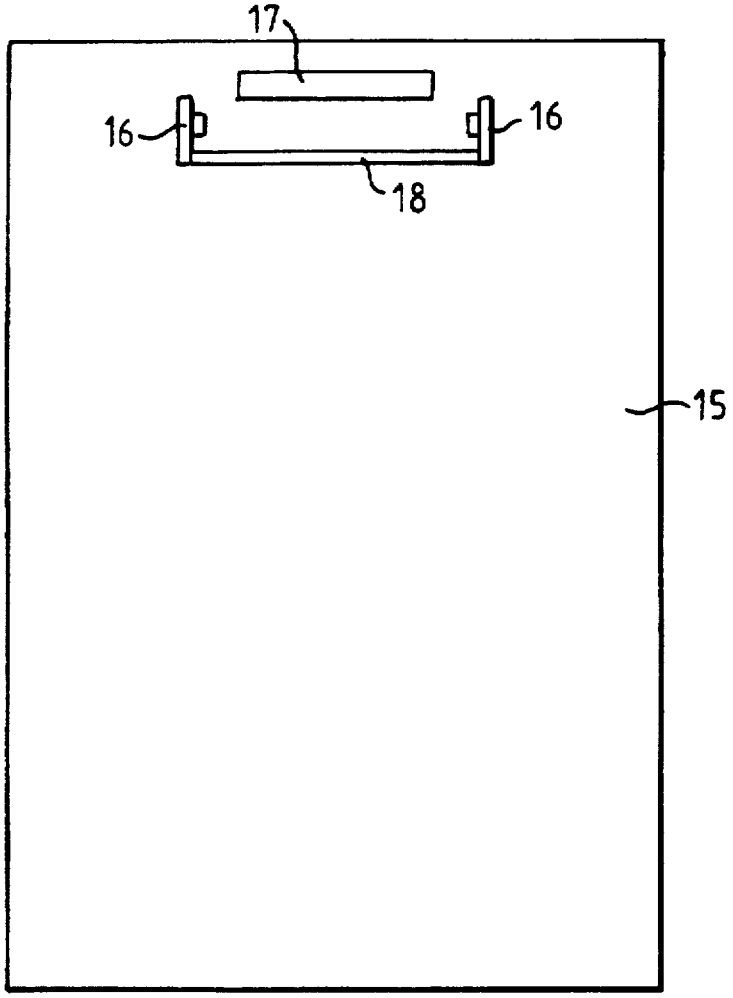
FIG. 7 shows a clip board according to the present invention.

FIG. 7 is a plan view of an integrally moulded base for a clip board. The board 15 may be integrally moulded of polypropylene or other suitable material. Integrally moulded at one end are projections 16 corresponding to the projections 4 shown in FIG. 1 and a cam piece 17 having a cam surface, corresponding to cam surface 10 shown in FIG. 1. A strengthener bar 18 (not shown in FIG. 1) is shown, which provides rigidity to the construction. A suitably dimensioned clip part 3 as shown in FIG. 1 may be snapped into place by engaging the pivot projections 5 with the projections 16 shown in FIG. 7 to provide a clip board comprised entirely of thermoplastic material.

I claim:

1. A hand operable clip comprising:

molded first and second members that are integrally formed, each of which comprises a respective gripping surface, the first and second members being journalled with respect to one another for pivotal movement; and biassing means for biassing the gripping surfaces of the first and second members into contact, wherein the biassing means comprises a plastic resilient member integral with one of the first and second members and a cam surface that is smoothly profiled, that comprises a sharp edge and that is integral with and extends from a surface of one of the first and second members toward the resilient member, wherein the resilient member moves over the cam surface to resist rotational movement of the first and second members tending to separate the gripping surfaces, the movement of the resilient member defining varying respective positions of both the resilient member and the cam surface wherein either or both of the cam surface and the resilient member defines a surface that extends over varying radial distances from a center of pivotal motion, and wherein one of the first and second members on which the resilient member is integrally formed is composed of acetal and the other of the first and second gripping members comprises polypropylene.

2. A hand operable clip according to claim 1, wherein the first and second members can be snap fitted together.

3. A hand operable clip according to claim 2 comprising means integrally formed on a part of the clip for holding a cylindrical object such as a pen or pencil.

4. A hand operable clip according to claim 3, wherein said gripping surfaces are serrated or roughened.

5. A hand operable clip comprising first and second gripping members pivotally coupled to one another at a pivotal connection and having respective gripping surfaces at an end remote from the pivotal connection, a cam extending from one of the gripping members and a resilient polymeric member extending from the other of the gripping members for engaging the cam to urge the gripping surfaces toward one another, wherein the resilient polymeric member comprises a generally triangular cross-sectional extension of one of the gripping members which extends toward the other griping member and wherein the cam includes an inclined surface engaging the resilient polymeric member.

6. A hand operable clip, comprising first and second gripping members pivotally coupled to one another at a pivotal connection and having respective gripping surfaces at an end remote from the pivotal connection, a cam extending from one of the gripping members and a resilient polymeric member extending from the other of the gripping members for engaging the cam to urge the gripping surfaces toward one another, wherein the resilient polymeric member comprises an extension of one of the gripping members which extends toward the other griping member and wherein the cam includes an inclined surface engaging the resilient polymeric member.

* * * * *

UNITED STATES PATENT AND TRADEMARK OFFICE

CERTIFICATE OF CORRECTION

PATENT NO. : 5,774,946
DATED : July 7, 1998
INVENTOR(S) : Donald Albert Morgan

It is certified that error appears in the above-identified patent and that said Letters Patent is hereby corrected as shown below:

Cover page, in the Assignee information, delete "Marks & Clerk, United Kingdom".

Column 1, line 5, "e.g." should be --e.g.,--.

Column 3, line 31, "users" should be --user's--.

Column 3, line 42, "it" should be --It--.

Column 3, lines 43 and 44, "0.5-4. 0mm" should be --0.5-4.0 mm--.

Column 6, line 15, "griping" should be --gripping--.

Column 6, line 26, "griping" should be --gripping--.

Signed and Sealed this

Twenty-sixth Day of October, 1999

*Attest:*

Q. TODD DICKINSON

*Attesting Officer*

*Acting Commissioner of Patents and Trademarks*